US012765627B2

(12) United States Patent
Lipkens et al.

(10) Patent No.: US 12,765,627 B2
(45) Date of Patent: Oct. 20, 2026

(54) VISOR ASSEMBLY

(71) Applicant: PINLOCK PATENT B.V., Lelystad (NL)

(72) Inventors: Paul Wilhelmus Lipkens, Meeuwen-Gruitrode (BE); Herman De Boer, Huizen (NL)

(73) Assignee: Pinlock Patent B.V., Lelystad (NL)

( * ) Notice: Subject to any disclaimer, the term of this patent is extended or adjusted under 35 U.S.C. 154(b) by 0 days.

(21) Appl. No.: 16/756,131

(22) PCT Filed: Oct. 16, 2018

(86) PCT No.: PCT/EP2018/078246

§ 371 (c)(1),
(2) Date: Apr. 15, 2020

(87) PCT Pub. No.: WO2019/076894

PCT Pub. Date: Apr. 25, 2019

(65) Prior Publication Data

US 2020/0329803 A1 Oct. 22, 2020

(30) Foreign Application Priority Data

Oct. 16, 2017 (EP) ..... 17196686

(51) Int. Cl.
*A42B 3/22* (2006.01)
*A42B 3/24* (2006.01)

(52) U.S. Cl.
CPC ..... *A42B 3/226* (2013.01); *A42B 3/221* (2013.01); *A42B 3/24* (2013.01)

(58) Field of Classification Search
CPC ..... A61F 9/025; A61F 9/022; A61F 9/023; A61F 9/026; A61F 9/02; A61F 9/029; A42B 3/226; A42B 3/221; A42B 3/24; A42B 3/222; A42B 3/26; G02C 11/08; G02C 9/00; G02C 2200/08; G02C 7/16
See application file for complete search history.

(56) References Cited

U.S. PATENT DOCUMENTS 5,084,918 A * 2/1992 Breining ..... A42B 3/326 2/424
5,131,101 A * 7/1992 Chin ..... A42B 3/226 2/432
5,765,235 A * 6/1998 Arnold ..... A42B 3/24 2/424

(Continued)

FOREIGN PATENT DOCUMENTS

EP 2842443 A1 * 3/2015 ..... A42B 3/326
JP 2016148135 A 8/2016

(Continued)

*Primary Examiner* — Grady Alexander Nunnery
(74) *Attorney, Agent, or Firm* — Hoyng Rokh Monegier

(57) ABSTRACT

There is provided a visor assembly (1), preferably for the motorcycle helmet, comprising a shield-visor (2) having a surface, an overlay-visor (6) adapted to be releasably attached to the shield-visor, the overlay-visor comprising a viewing area, an integrally formed spacer (7) extending along at least a portion of a periphery of the viewing area, and a gasket (8) upon a distal surface of the spacer; and a mechanical fastening (11) releasably attaching the overlay-visor to the surface of the shield-visor.

9 Claims, 4 Drawing Sheets

(56) References Cited

U.S. PATENT DOCUMENTS 6,161,225 A * 12/2000 Arai ..... A42B 3/226 2/424
6,321,386 B1 * 11/2001 Monica ..... A41D 31/065 2/412
6,405,373 B1 * 6/2002 Grau ..... A42B 3/24 2/424
6,922,850 B1 * 8/2005 Arnold ..... A42B 3/24 2/424
2004/0156115 A1 * 8/2004 Iori ..... A42B 3/22 359/642
2006/0206995 A1 * 9/2006 Hong ..... A42B 3/226 2/424
2008/0055538 A1 * 3/2008 Kobayashi ..... G02B 1/18 2/436
2009/0293165 A1 * 12/2009 Arnold ..... A42B 3/226 2/15
2010/0175160 A1 * 7/2010 Arnold ..... B29C 45/14336 425/129.1
2011/0072563 A1 * 3/2011 Choi ..... F16B 21/02 2/422
2012/0047637 A1 * 3/2012 Arnold ..... G02B 1/14 2/424
2012/0102628 A1 * 5/2012 Righi ..... A42B 3/226 2/243.1
2013/0129449 A1 * 5/2013 Ishikawa ..... F16B 5/10 411/509
2014/0259321 A1 * 9/2014 Arnold ..... A42B 3/226 2/424
2015/0150724 A1 * 6/2015 Arnette ..... A61F 9/025 2/439
2015/0153492 A1 6/2015 Arnold
2015/0305427 A1 * 10/2015 Prabhu ..... A42B 3/061 2/412
2017/0006953 A1 * 1/2017 Kataoka ..... B29C 65/48
2017/0021203 A1 * 1/2017 Baker ..... A62B 7/12
2017/0150768 A1 6/2017 Lipkens
2017/0196294 A1 * 7/2017 Fischer ..... A42B 3/328
2018/0077992 A1 * 3/2018 Kataoka ..... A61F 9/029
2018/0213875 A1 * 8/2018 Tutunaru ..... A42B 3/128
2018/0333940 A1 * 11/2018 Parker ..... B32B 23/20
2019/0107247 A1 * 4/2019 Teetzel ..... F16B 47/003

FOREIGN PATENT DOCUMENTS

JP 2017512925 A 5/2017
WO WO-2011141047 A1 * 11/2011 ..... A42B 3/226
WO WO-2015149137 A1 * 10/2015 ..... A42B 3/222

* cited by examiner 3
2
6
1
7
11
11

11
12

6
7

2
11
1

6
13
15
7
18
8

6
13
7
15
18
8

6
13
15
7
8
18

13
15
7
8
18

13

23
7
6

7
6
24
1
2

VISOR ASSEMBLY

BACKGROUND OF THE INVENTION

1. Field of the Invention

The invention relates generally to visor assemblies that comprise an overlay-sheet and a shield-visor, which overlay-sheet and shield-visor are releasably attached to one another; and a kit of parts for constructing such a visor assembly.

The invention may also or alternatively generally relate to a visor, particularly an overlay-visor, for use in a visor assembly in which an overlay-visor and a shield-visor are releasably attached to one another.

The visors and visor assemblies of the invention are particularly useful for personal protection equipment for facial and eye protection. Examples of preferred personal protection equipment include motorbike helmets, motorbike style helmets such as quad-bike, snowmobile, racing car and skiing helmets; heavy-duty protective visors, for example, ballistic face shields which may be used in riot helmets and visors for use by the emergency services; and/or goggles such as underwater diving goggles, motorcycle goggles or skiing goggles.

The invention may also or alternatively generally relate to a method of manufacturing a visor, particularly an overlay-visor, such as may be used in a visor-assembly comprising an overlay-visor and a shield-visor releasably attached to one another. The invention may also relate to an apparatus for implementing such a method; a visor, particularly an overlay-visor, obtained from the method of the invention; and a visor assembly comprising a visor obtained from the method of the invention.

2. Description of the Related Art

Visor assemblies comprising a shield-visor with an overlay-visor releasably attached thereto by mechanical fastenings, are known.

In such visor assemblies the shield-visor is more substantial than the overlay-visor and acts as a shield. In the case of motorbike style helmets the shield-visor acts to protect a user's face from wind, rain, dirt and grit; and in the case of ballistic visors it acts to protect the user's face from more substantial projectiles and blows. In goggles the shield-visor tends to be limited to extending over the eyes and that part of face immediately adjacent the eyes. The shield-visor of the goggles may have different functions depending on usage. For example diving goggles are worn to aid underwater vision, motorcycle goggles are worn to protect a user's eyes from projectiles and dirt, and ballistic goggles are worn to protect a user's eyes from more substantial projectiles. Goggles may be provided with two shield-visors, one per eye.

Shield-visors may be provided in 1-dimensional (1-D) form, that is occupying a single plane so as to be flat; 2-dimensional (2-D) form, that is curved in one direction; or 3-dimensional (3-D) form, that is curved in two directions so as to be bowled. Overlay-visors may be provided in appropriate shapes to fit to the surfaces of these various shield-visor forms. In this respect, overlay-visors may also be 1-D, 2-D or 3-D. 1-D overlay-visors are used with 1-D shield-visors; 1-D and 2-D overlay-visors are used with 2-D shield-visors; and 3-D overlay-visors are used with 3-D shield-visors.

The overlay-visor is typically utilized to provide an improved viewing window for the visor wearer. For example, the overlay-visor may be adapted to have an anti-condensation function to prevent misting-up of the viewing area. The overlay-visor may also or alternatively be provided with tinting to give improved viewing in varying light conditions. The viewing area of the shield-visor and/or the overlay-visor is the area through which the user looks.

Examples of helmet visor assemblies are known from U.S. Pat. Nos. 5,765,235 and 6,922,850, the contents of which are hereby incorporated by reference in their entirety, which provide anti-condensation overlay-visors attached to shield-visors.

In U.S. Pat. No. 6,922,850, prevention of misting-up of the viewing area is preferably achieved by provision of a chamber between an inner overlay-visor and a shield-visor. The chamber is filled with air or gas and acts to thermally insulate the internal surface of the overlay-visor from the external environment. The chamber is created by the provision of a flexible seal adhered to the overlay-visor and fitted detachably against the shield-visor so that the seal forms the peripheral boundary of the chamber. For the best anti-condensation results the chamber is sealed as far as possible with respect to the environment to prevent ingress of moisture and dirt to the chamber. In the preferred embodiment of U.S. Pat. No. 6,922,850 the seal is formed from a bead of silicone material adhered to the overlay-visor.

In a visor that is provided with a seal the viewing area is defined by the seal, which forms the boundary of the viewing area.

The visors are provided with secure yet readily releasable mechanical retention systems for retaining the overlay-visor. The retaining system takes the form of pin-shaped elements against which the overlay-visor abuts. Recesses are provided in the overlay-visor which engage with the pins to provide a secure retention on the inside of the shield-visor by compression of the inner-visor. Such a system offers excellent retention of an inner overlay-sheet.

Furthermore, so that the overlay-visor is detachable from the shield-visor, the bead of silicone material is dry and set before it is brought into contact with the shield-visor. In this manner there is no adherence between the shield-visor and the spacer or seal so that the overlay-visor can be removed from the assembly or be replaced.

The currently dominant method of forming the silicone spacer/seal comprises application of a viscous silicone resin as an extruded bead of material along the periphery of a prefabricated overlay-visor using a computer numerical controlled (CNC) machine. The CNC machine controls a silicone dispensing nozzle which dispenses the bead of silicone resin under pressure onto the overlay-visor in the appropriate pattern. Once the resin has been applied to the overlay-visor, the bead dries/sets for between 24 to 48 hours depending upon the thickness of the spacer or seal and environmental conditions.

In such a process accurate computer numerical control has to be utilised in order to achieve excellent bead placement, bead thickness and bead cross-section control. It has been identified by the inventor of the present invention that accurate control of the bead placement, bead thickness and bead cross-section are all essential to achieving a good seal to the chamber and hence a good anti-misting function of the overlay-visor. In order to achieve a highly effective seal, the dispenser speed, pressure, start and finishing points, and height of nozzle above the overlay-visor, all have to be synchronously coordinated. With such a process a number of problems occur.

The overlap at the start and finishing points for laying down the bead can cause problems with regards to optical quality of the final product as well as causing leakages into a sealed chamber because of a thickening or thinning of the bead at these points. The withdrawing of the nozzle can also lead to fowling of the nozzle.

The thickness and height of the completed set silicone bead cannot be guaranteed because the bead of silicone resin sets and flows differently according to the environmental conditions.

Once the silicone has been applied to the overlay-visor, it must be allowed to set in a controlled and dust free atmosphere for between 24 to 48 hours. If the drying room is not a clean room free of dust particles, these particles will irremovably ingress to the unset silicone resin. This leads to a poor optical quality of the set silicone and potentially poor sealing qualities.

For these reasons the currently dominant manufacturing process can be overly time consuming and too often produce a less than perfect spacer or seal Alternatives to the above technique have been discussed in the art.

For example in publication US20100175160A1, a method of manufacturing is discussed in which a visor having a spacer or seal extending along at least a portion of a periphery of a viewing area of the visor, comprises injection molding the seal or spacer. While such techniques can provide excellent seals and spacers, and answer at least some of the above concerns, the manufacturing can be complex and not readily diversified to an extended product line up of varying visor shapes.

Another example is found in US2017150768AA, which discusses a visor assembly with an inner-shield that has a spacer extending along its periphery. The spacer functions to space the inner shield from the outer shield. In that publication, the inner shield is formed at the position of its periphery such that a protrusion from the inner shield is obtained, that protrusion forming the spacer. It is indicated in US2017150768AA, in agreement with the above, that the spacer of the more common type of inner lens (formed from a silicone material which is adhered to the inner shield but not to the outer shield) has drawbacks in that the manufacture is complex and time-consuming with the silicone layer having to be arranged with a constant thickness along the periphery of the inner shield, with dust-free, extended cure times. US2017150768AA, purports to answer at least some of those problems.

However, it has been identified through research efforts that while the techniques and visor described in US2017150768AA may be useful, the visors can still be further improved. Namely, it has been determined that under some circumstances expansion and/or shrinkage of visor components can occur, particularly shrinkage of the inner-visor, and that some visors according to US2017150768AA may become loose on their mechanical fittings, because they are no longer held in compression between the pins. This can be problematic for a number of reasons that can depend upon the use to which the visor assembly is put, e.g. for motorcycle riding. For example, any play between components can lead to irritating noise and abrasion e.g. of the viewing region of the visor, and ultimately to the overlay-visor coming free from its attachments.

While an apparent route to answering such a problem would be to more solidly affix the inner-visor to an outer-visor, e.g. by use of bolts or screws, these solutions can be undesirable because of increased complexity and user inconvenience.

It is the aim of the invention to overcome one or more of the above problems, preferably while at the same time maintaining advantages of the known overlay-visors and visor assemblies.

SUMMARY OF THE INVENTION

According to an aspect of the invention there is provided a visor assembly, comprising a shield-visor having a surface; an overlay-visor; and a mechanical fastening releasably attaching the overlay-visor to the shield-visor, wherein the overlay-visor comprises a viewing area, an integrally formed spacer extending along at least a portion of a periphery of the viewing area, and a gasket upon a distal surface of the spacer.

According to another aspect of the invention, there is provided an overlay-visor for use in the described visor assembly. The overlay-visor comprises a viewing area, an integrally formed spacer extending along at least a portion of a periphery of the viewing area, and a gasket upon a distal surface of the spacer adapted to be releasably attached to the shield-visor.

The gasket aids in take up of expansion and shrinkage, especially shrinkage of the overlay-visor, and delays the point in time at which the overlay-visor becomes loose, for example due to loss of tension between mechanical retention means, such as retaining pins.

The gasket may take the form of an elastomeric layer adhered to a distal surface of the spacer, and acts as an interface between the overlay-visor and the shield-visor's surface.

The gasket is non-adhesive, or temporarily adhesive, preferably non-adhesive, on a side that interacts with the shield-visor. In this manner the overlay-visor can be removed from the shield-visor so that it can be replaced if damaged, or removed or replaced depending upon weather conditions. Moreover, it allows some controlled movement between the overlay-visor and shield-visor, which may be important if the overlay-sheet and the visor are made of different materials, or subject to different temperature or other environmental conditions, leading to differences in expansion and contraction or shrinkage. For example, the shield-visor may be formed of polycarbonate, while the overlay-visor can comprise a number of different materials, particularly preferred are polymeric resins. Examples of particularly preferred materials are cellulose propionate and cellulose acetate.

In a preferred embodiment the gasket comprises an elastomer material. Preferably said elastomer material is a silicone or a rubber material. This type of material is elastically deformable which is advantageous. It is also preferred that the gasket material is transparent.

The term elastomer refers to a rubbery material composed of long chainlike molecules, or polymers, that are capable of recovering their original shape after being stretched to great extent-hence the name elastomer, from "elastic polymer". Exemplary elastomers include polyisoprene, the polymer constituent of natural rubber and synthetics, such as styrene-butadiene rubber, butadiene rubber, acrylonitrile-butadiene copolymer (nitrile rubber), isobutylene-isoprene copolymer (butyl rubber), polychloroprene (neoprene), polysulfide (Thiokol), polydimethyl siloxane (silicone), fluoroelastomer, polyacrylate elastomer, polyethylene (chlorinated chlorosulfonated), styrene-isoprene-styrene (SIS, styrene-butadiene-styrene (SBS) block copolymer, EPDM-polypropylene blend.

The elastomer resin used to form the spacer or seal may also preferably be a low-temperature setting resin. This advantageously allows curing to occur at temperatures that do not adversely affect the qualities of the (e.g. optical) of the overlay-visor; cause undesired size or shape changes in the visor; or adversely affect surface coatings or finishes (e.g. anti-scratch or anti-misting coatings) on the visor. Elastomeric resins are preferably selected to be curable at 90° C. or below, more preferably 70° C. or below; even more preferably 60° C. or below; and most preferably 50° C. or below.

The gasket may also comprise foams, preferably closed cell foams, such as closed cell acrylic foams or closed cell cross-linked polyethylene foams, or closed cell polyurethane foam, or other similar materials. To achieve adhesion of a foam gasket to the integrally formed spacer, the foam may be provided on one side with an adhesive layer.

In a preferred embodiment the gasket elastomer material has a Shore A hardness of 50-95, more preferably 60-90, even more preferably 65-80, most preferably 70. The Shore A scale is used to measure the hardness of elastomers, rubber-like materials, and elastomer materials like polyurethane. The method of Shore A hardness measurement is one using a durometer as described in standard ISO 7619-1: 2010.

The gasket may be applied to the distal surface of the spacer by a number of techniques.

For example, the gasket may be applied by coating, painting, brushing, spraying, extrusion via a nozzle, or any other appropriate method, where the gasket material is applied as a fluid that cures in situ upon the spacer. It is also possible to use an extrusion method involving extrusion of a bead of the gasket material from a nozzle onto the spacer's distal surface, for example by CNC techniques.

Alternatively, the gasket may be prefabricated as a solid or semi-solid, which is pre-formed to match the shape of the spacer and then be joined to the spacer by adhesion techniques, or by ultrasonic welding.

The integrally formed spacer may have the same material composition as the material of the viewing area or the overlay-visor. The spacer may be integrally formed from the overlay-visor material, preferably by physical deformation, more preferably using thermoforming.

The integrally formed spacer with added gasket may be formed to have a constant height, but may also have a height that varies along its length. This can be useful in circumstances where it is desirable for a visor assembly to have a varied spacing of the overlay-visor and the shield-visor. For example, in a motorbike helmet visor assembly it may be desirable to have a narrow spacing at the upper portion of the visor assembly and a deeper spacing at the lower portion of the visor assembly. This helps to avoid a scratching contact of the overlay-visor with the helmet components when lifting the visor assembly. In another embodiment the spacing may be greater at the lateral side portions than in the central portion.

In a particular example the height of the spacer with gasket may be about 0.5 mm along a first portion of a visor with a seamless graduation to 1.0 mm at an opposed portion of the visor. In this manner a chamber is provided with a gradually increasing spacing from one portion to another. Preferably, the height variation is achieved by variation in the height of the integrally formed spacer, and the gasket has a constant thickness.

In general, the spacing between the overlay-visor and the shield-visor can be adjusted to optimise the anti-misting properties of the assembly, by adjustment of the height of the integrally formed spacer.

In embodiments where application of a gasket is done by nozzle extrusion, this can lead to an increase in thickness of the gasket at a point of overlap where the laying down of the extruded bead starts and finishes. To accommodate a locally thickened point, the spacer height may be locally reduced to accommodate the thickening of the gasket.

The gasket thickness is preferably small compared to the height of the spacer. This reduces the elastomer material in the gasket, which can minimize costs, and simplify manufacturing by limiting cure times. Preferably the gasket thickness is maximally 10% or less than the height of the spacer, more preferably less than 5%, still more preferably less than 2%. The gasket thickness is the dimension of the gasket extending away from the distal surface of the spacer toward the shield-visor contact surface. The thickness of the gasket refers to its thickness when not compressed.

Preferred cross-sections for the spacer include U-shaped, Z-shaped, and W-shaped.

In the U-shaped and Z-shaped cross sections, the lower edge of the U and Z forms the distal surface of the spacer to which the gasket is applied. The W-shaped cross section, is particularly advantageous as it forms a concave channel at its lower edge into which the gasket material can be applied by the techniques previously discussed. While a W-shaped cross-section provides only a single channel at its distal surface, more channels may also be provided. Cross sections comprising one or more channels for receiving the gasket may generally be used.

The distal surface of the spacer may be treated mechanically or chemically to increase its surface roughness as compared to the adjacent surface of the overlay-visor.

The overlay-visor is in one embodiment provided as a visor prefabricated by cutting or milling from a sheet of material. The overlay-visor may alternatively be formed by injection molding, or other known techniques.

The spacer is preferably integrally formed into the overlay-shield by mechanical deformation of the overlay-shield. This can be done, for example, by mechanical deformation, preferably thermally, with a mould. That is, a sheet-like overlay-shield can be provided with a protrusion in a simple manner via mechanical deformation.

The protrusion that forms the integrally formed spacer, is preferably formed as a continuous channel running around a central zone of the overlay-visor. The central zone encompasses the viewing area of the overlay-visor. The continuous channel preferably has a substantially constant depth. Because the channel is continuous and runs around a central zone of the overlay-visor, and because the channel has a substantially constant depth, it will be possible to press the overlay-visor against the shield-visor in a manner such that the central zone is sealed airtightly from the surrounding area. An insulating effect is hereby obtained, which can improve the performance of the visor assembly in extreme conditions. The substantially constant depth is defined here as a depth which does not change, or does so only very gradually. Owing to a gradual change in the depth the protrusion will still be able to lie against the shield-visor in continuous manner and with a constant force, When change is gradual, the depth will therefore also be considered as being substantially constant. On the basis of this definition it will be apparent that an embodiment wherein the protrusion has a depth of 3 mm at the position of a first segment of the periphery, this protrusion decreasing gradually over a second segment of the periphery to a depth of 1 mm and then gradually becoming deeper again via a third segment, is also deemed an embodiment with substantially constant depth.

The gasket may be applied to a distal surface of the spacer by the techniques discussed herein.

In a preferred embodiment the shield-visor of the visor assembly is provided with a recess shaped to receive an overlay-visor. The dimensions of the recess preferably corresponds closely to the peripheral dimensions of the overlay-visor. The depth of the recess is preferably such that when the overlay-visor is inserted it sits substantially flush with the un-recessed part of the shield-visor. In such an embodiment securing means may be provided in the form of a snap-fit rim or the like around at least a part of the recess periphery. Mechanical pins are also a preferred attachment mechanism in recessed shield-visors.

Preferably overlay visor assemblies are provided with secure yet readily releasable mechanical retention systems for retaining the overlay-visor. The retaining system preferably takes the form of pin-shaped elements against which the overlay-visor abuts. Recesses are provided in the overlay-visor which engage with the pins to provide a secure retention on the inside of the shield-visor by compression of the inner-visor. Such a system offers excellent retention of an inner overlay-sheet.

As discussed, the overlay-visor maintains a user's vision through the visor assembly. In relation to this the overlay-visor is preferably provided with an anti-misting surface, for example, in the form of a surface having hydrophilic properties. The surface may be applied as a coating of a hydrophilic material. The coating is preferably a silicone based material which is applied by dip-coating. More preferably the overlay-visor is also provided with an anti-misting surface on both of its major surfaces.

The overlay-visor may also or alternatively be provided with a colouring agent in the form of a permanent colouring or a photo-chromic UV reactive dye. This acts to reduce the ingress of excess light during, for example, sunny conditions, or to filter particular wavelengths of light.

The overlay-visor may be provided with an anti-scratch coating, separately or in combination with an anti-misting surface, on either or both of it major surfaces. Preferably the overlay-visor is provided with an anti-misting surface on one side and an anti-scratch surface on the other side.

The visor assembly of the present invention can conveniently be provided as a kit of parts comprising an overlay-visor as discussed above, and a shield-visor as discussed. Optionally the kit of parts may also comprise a safety helmet on which the visor assembly can be fitted.

According to a further aspect of the invention there is provided a helmet comprising; an opaque skull protection portion; and a visor assembly as discussed above.

According to another aspect of the invention there is provided a safety helmet assembly comprising a safety helmet, and a visor assembly as discussed above fitted, or suitable to be fitted to the safety helmet.

In addition to, independently of, or in combination with the above, the inventors have developed an improved pin fastening system, which independently and/or synergistically offers at least some solution to the problems posed above. In this embodiment, the a recess in the overlay visor, for interaction with a pin mechanical fixing means, comprises an upstanding collar. The collar holds the pin in tension away from the overlay-visor, and so provides a secure connection, which suffers less from loosening upon contraction or shrinkage of the overlay-visor.

BRIEF DESCRIPTION OF THE DRAWINGS

Specific embodiments of the invention will now be described by way of non-limiting example only. The features and advantages of the invention will be further appreciated upon reference to the following drawings, in which.

DESCRIPTION OF ILLUSTRATIVE EMBODIMENTS

Figures 1, 2, 2A, 2B:
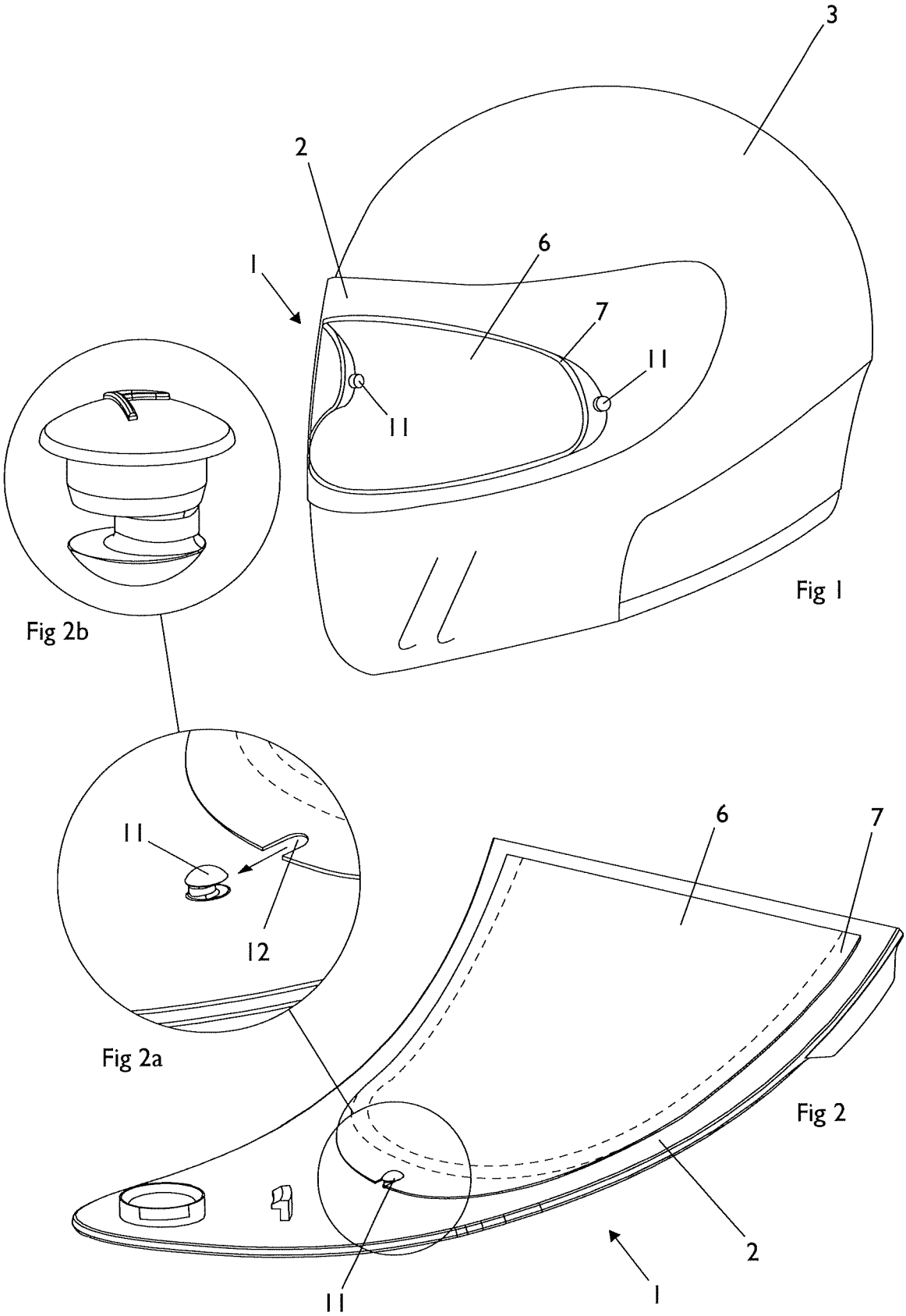
FIG. 1 shows a motorcycle style helmet provided with a visor assembly.
FIGS. 2, 2*a* and 2*b* show details of the visor assembly of FIG. 1.

FIG. 1 shows a motorcycle helmet having an opaque skull protecting portion 3 to which is attached a 3D visor assembly 1. There is provided a shield-visor 2 having releasably attached to its inner-surface an overlay-visor 6. The overlay-visor 6 is releasably attached to the shield-visor 2 by mechanical fastening pins 11 at opposed ends of the shield-visor 2.

The mechanical fastening pins 11 can be seen more clearly in FIGS. 2, 2*a* and 2*b*. It is comprised of an eccentric pin 11 fitted to the shield-visor 2. The overlay-visor 6 is provided with a recess 12 that mates with the eccentric pin 11. The mechanical fastening pins 11 hold the overlay-visor 6 under tension within the inner curve of the shield-visor 2, that is the overlay-visor 6 is compressed between the pins 11. The eccentric pins 11 of this embodiment are rotatable into and out of engagement with the recesses 12 of the overlay-visor 6 in order to ensure a secure retention thereof. In the event that the overlay-visor 6 should reduce in size in relation to the shield-visor 2, the eccentric pins 11 can be tightened to re-secure the overlay-visor. The pins 11 and recesses 12 so form a releasable mechanical retention holding the overlay-visor 6 against the inner side of shield-visor 2. Other mechanical fixing constructions known in the prior art may be applied instead of the shown fixings.

Also illustrated in FIGS. 1 and 2 is a spacer 7 extending around the periphery of the overlay-visor 6. The spacer 7 is an integrally formed part of the overlay-visor 6.

As a result of the presence of this spacer 7, the overlay-visor 6 is spaced from the shield-visor 2 and a chamber is formed between the overlay-visor 6 and the shield-visor 2. This chamber acts as an insulator reducing condensation formation in the viewing area of the shield-visor 2. It will be clear to those skilled in the art that the spacer 7 may be provided at alternative locations on the overlay-visor 6 so long as it encompasses an adequate viewing area for the visor user. For example the overlay-visor may be larger than the viewing area of the shield-visor but the spacer 7 is located on the periphery of the viewing area, and thus not on the periphery of the overlay-visor 6.

Referring to FIGS. 3*a*-3*d*, these show partial sections through overlay-visors 6 provided with spacers 7, the spacer 7 carries a gasket 8 of elastomeric material upon a distal surface 18 such that the gasket 8 is positioned between the spacer 7 and the inner surface of the shield-visor 2 when held in place between the pins 11 for use.

The gasket 8 aids in take up of expansion and shrinkage, especially shrinkage of the overlay-visor 6, delaying the point at which the overlay-visor 6 becomes loose between the tensioning pins 11.

The overlay-visor 6 is a single-piece element including the part that is the viewing area and its spacer 7. That is, the overlay visor 6 is integrally formed as single-piece element.

Figures 3A, 3B, 3C, 3D:
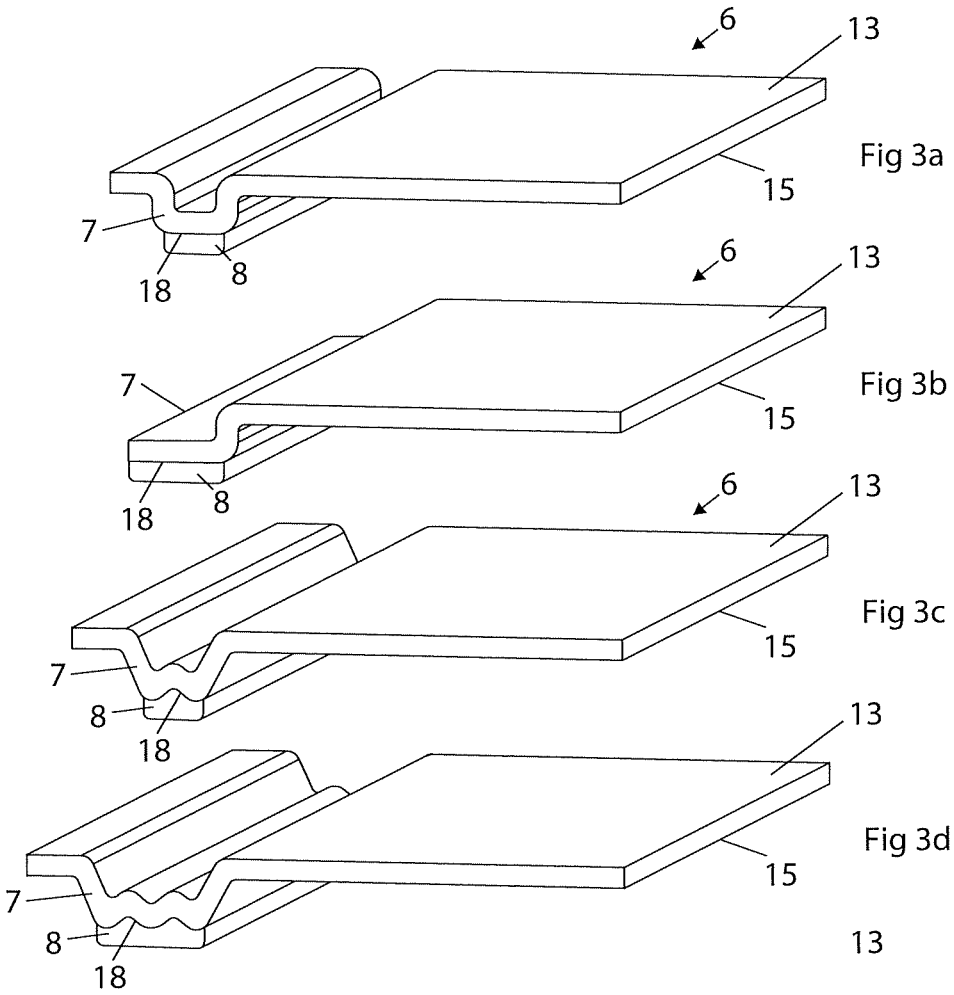
FIGS. 3*a* to 3*d* show partial sections through overlay-visors with various spacer forms.

In FIG. 3*a* overlay-visor 6 is provided with an integrally formed U-shaped cross section spacer 7 with an elastomer gasket 8 applied to its distal surface 18. The spacer 7 diverts out of the major plane of the overlay-visor 6. The spacer 7 extends out of a second surface 15 of the overlay-visor. In use, the first surface 13 of the overlay-visor 6 faces a user's face, and a second surface 15 opposite thereto, faces an inner surface of the shield-visor.

In FIG. 3*b* overlay-visor 6 is provided with an integrally formed Z-shaped cross section spacer 7 with an elastomer gasket 8 applied to its distal surface 18.

In FIG. 3*c* overlay-visor 6 is provided with an integrally formed W-shaped cross section spacer 7 with an elastomer gasket 8 applied to its distal surface 18.

In FIG. 3*d* overlay-visor 6 is provided with an integrally formed double concave channel cross section, with a gasket 8 applied to its distal surface 18.

In the cross sections of FIGS. 3*a*-3*d*, the material of the overlay visor 6 diverts out of its major plane at the position of the spacer 7. The spacer 7 may be obtained by deforming, preferably thermoforming and/or molding, a sheet material.

The manufacture of such an overlay-visor 6 with spacer 7 is quick and easy. Using a sheet material, overlay-visor 6 can be cut into the desired shape and be deformed in one processing step in order to obtain the spacer 7 along the periphery of overlay-visor 6. This processing step can be performed in a mold having cutting edges for cutting out the periphery of overlay visor 6 and having deforming surfaces for creating the spacer 7 in the sheet-like material.

An alternative embodiment of the invention is that the overlay-visor 6 is manufactured by injection molding. In one example a multi-component injection molding process may be used to form the overlay-visor 6 with integrally formed spacer 7, with addition of the gasket 8. In this process the gasket 8 can injection molded into the same mold in which the overlay-visor 6 with spacer 7 is molded. For example via 2-component injection molding.

Figures 4, 4A:
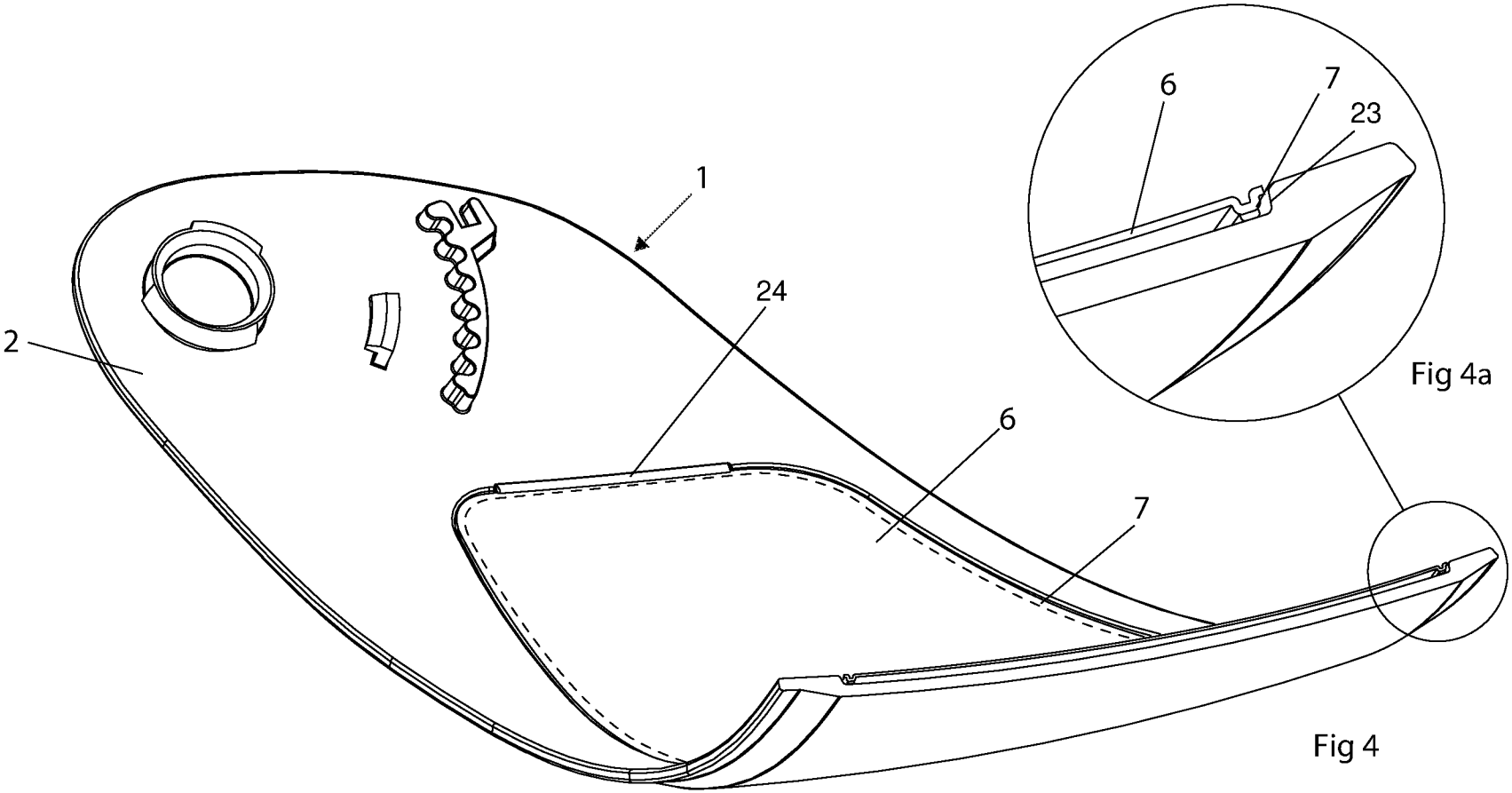
FIGS. 4 and 4*a* show a visor assembly having a shield-visor with a recess.

In FIGS. 4 and 4*a* there is shown a visor assembly 1 in which the shield-visor 2 is provided with a recess 23. The dimensions of the recess correspond to the external dimensions of the overlay-visor 6. The fastening in this embodiment is achieved by a snap-fit construction comprising snap-lips 24. This pushes the overlay-visor 6 against the shield-visor 2 with some pretension. The elasticity of gasket 8 aids in ensuring that despite shrinkage or contraction, the overlay-visor 6 remains securely bedded.

Figure 5:
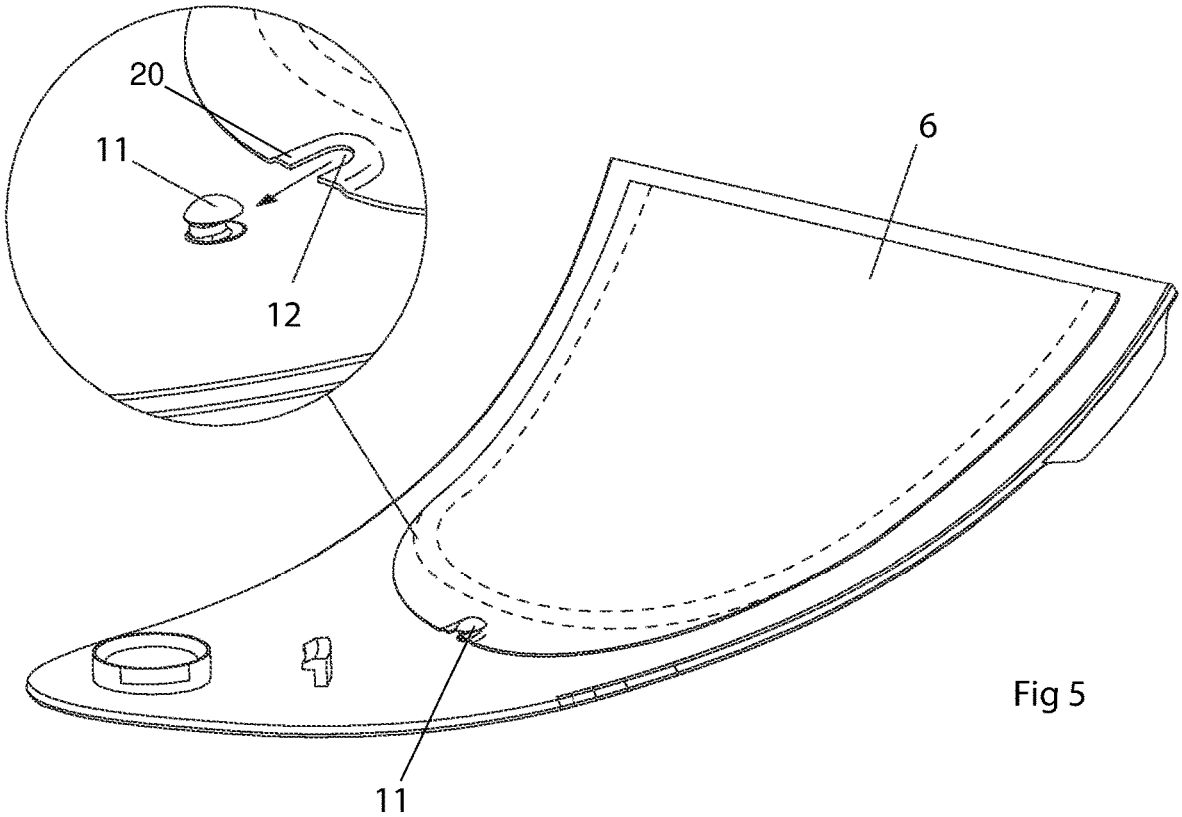
FIG. 5 shows an overlay visor having a raised collar in its pin recess.

In FIG. 5, a pin fastening system is shown, which comprises a collar 20 forming the recess 12. The collar 20 interacts with pin 11 to provide a secure retention of the overlay visor 6 upon the pins 11. The collar 20 engages with mushroomed or overhanging heads or radial lips or extensions of pins 11, compressing the overlay-visor 6 into the shield-visor 2 with some pretension. The collar 20 may in this manner aids in take maintaining a secure retention of the overlay-visor 6 despite some shrinkage thereof.

Similarly to the spacer 7, the collar 12 may be obtained by deforming, preferably thermoforming and/or molding a sheet material, or by injection molding of the overlay-visor 6.

In the embodiment of FIG. 5, the gasket as discussed may optionally be used, and is preferably used.

Many modifications in addition to those described above may be made to the structures and techniques described herein without departing from the spirit and scope of the invention. Accordingly, although specific embodiments have been described, these are examples only and are not limiting upon the scope of the invention.

It should be noted that the term "comprising" as used in the claims or description of this application does not exclude other elements or steps; and the terms "a" and "an" do not exclude a plurality.

Equivalents and modifications not described above may also be employed without departing from the scope of the invention, which is defined in the accompanying claims.

What is claimed is:

1. A visor assembly, comprising:

a shield-visor having a surface comprising pins;

an overlay-visor releasably attached to the shield-visor, the overlay-visor comprising a viewing area, the overlay-visor further comprising an integrally formed spacer extending along a periphery of the viewing area of the overlay-visor, wherein the integrally formed spacer is formed by deforming the overlay-visor; and a gasket disposed upon a distal surface of the integrally formed spacer, wherein the shield-visor is disposed so that an inner surface of the shield-visor is placed against the gasket to form a closed chamber between the overlay-visor and the shield-visor, wherein the gasket serves as an interface between the overlay-visor and the inner surface of the shield-visor, the gasket closing the closed chamber, wherein the gasket is a layer of elastomeric material adhered to said distal surface of the spacer, wherein the overlay-visor comprises recesses arranged to engage with said pins to provide a secure retention on the shield-visor by compression of the overlay-visor, wherein said recesses each comprise an upstanding collar arranged to hold said pins in tension away from the overlay-visor, the overlay-visor being formed from a sheet and wherein each upstanding collar is formed by deforming the sheet to provide a section of the sheet around each recess which is raised above a plane of the sheet, and wherein the shield-visor holds the overlay-visor by compression between the pins, and wherein the pins are eccentric pins fitted to the shield-visor, and the eccentric pins are rotatable into and out of engagement with the recesses of the overlay-visor.

2. The visor assembly according to claim 1, wherein the gasket is configured to be non-adhesive or temporarily adhesive on an external surface facing away from the overlay-visor.

3. The visor assembly according to claim 1, wherein the gasket is elastically deformable.

4. The visor assembly according to claim 1, wherein the gasket has a Shore A hardness of 50-95.

5. The visor assembly according to claim 1, wherein the spacer has a U-shaped, Z-shaped, or W-shaped cross section.

6. The visor assembly according to claim 1, wherein the spacer has a cross section comprising one or more distal channels, said one or more distal channels at least partially containing the gasket.

7. A helmet comprising:

an opaque skull protection portion; and the visor assembly according to claim 1 attached thereto.

8. The visor assembly according to claim 1, wherein each upstanding collar is adapted for engaging with one of said pins at a distance from an inside surface of the shield-visor and not at a position on the inside surface of the shield-visor.

9. The visor assembly according to claim 1, wherein the pins each comprise a mushroomed head.

* * * * *